US006019354A

United States Patent [19]

Vado et al.

[11] Patent Number: 6,019,354

[45] Date of Patent: Feb. 1, 2000

[54] DEVICE FOR WEIGHING LINES AND/OR ROPES, HAVING A THRUST RING FOR DEFLECTING A DRIVEN WHEEL

[76] Inventors: Giovanno Antonio Vado, Regione Taulera; Domenico Manca, Via Carrabuffas, both of 07041 Alghero(SS), Italy

[21] Appl. No.: 08/586,977

[22] Filed: Jan. 16, 1996

[30] Foreign Application Priority Data

May 31, 1995 [IT] Italy ..... RM950127 U

[51] Int. Cl.[7] ..... B66D 1/30

[52] U.S. Cl. ..... 254/371; 254/333

[58] Field of Search ..... 254/371, 373, 254/333

[56] References Cited

U.S. PATENT DOCUMENTS

| | | | |
|---|---|---|---|
| 3,120,043 | 2/1964 | Henley | 254/371 X |
| 3,635,441 | 1/1972 | Haines | 254/371 |
| 4,193,311 | 3/1980 | Rinio et al. | 254/371 X |
| 4,681,301 | 7/1987 | Rinio | 254/371 X |
| 4,815,710 | 3/1989 | Bonassi | 254/371 |
| 5,314,166 | 5/1994 | Muir | 254/371 |

FOREIGN PATENT DOCUMENTS

| | | |
|---|---|---|
| 0 172 975 | 3/1986 | European Pat. Off. . |
| 0 189 219 | 7/1986 | European Pat. Off. . |
| 0 301 657 | 2/1989 | European Pat. Off. . |

*Primary Examiner*—Donald P. Walsh
*Assistant Examiner*—Emmanuel M. Marcelo
*Attorney, Agent, or Firm*—Smith, Gambrell & Russell, LLP Beveridge, DeGrandi, Weilacher & Young Intellectual Property Group

[57] ABSTRACT

A device for weighing elongated members such as marine lines and ropes includes a hub, a motive wheel which is supported on the hub and is driven by a motor, and a driven wheel which is coupled to and driven by the motive wheel. The motive wheel and the driven wheel respectively form opposite sides of a groove for receiving the elongated member which is being weighed. A thrust ring is fixed to the driven wheel, and the motive wheel lies axially between the thrust ring and the driven wheel. The axial position of the driven wheel relative to the motive wheel is controlled by an idler roll which bears against the thrust ring and is adjustably mounted on the hub.

10 Claims, 1 Drawing Sheet

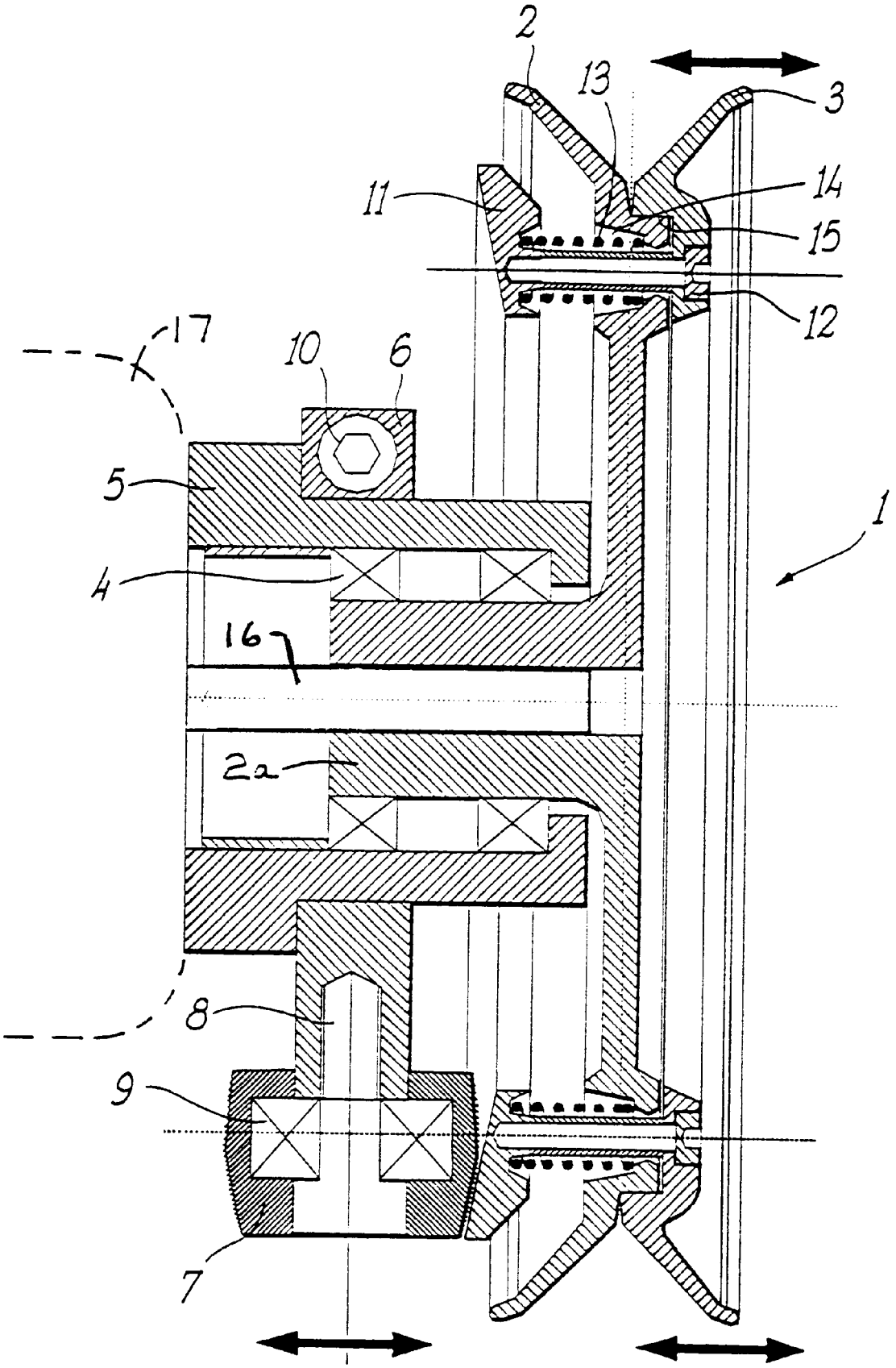
2
13
3
11
14
15
12
17
10
6
5
1
4
16
2a
8
9
7

DEVICE FOR WEIGHING LINES AND/OR ROPES, HAVING A THRUST RING FOR DEFLECTING A DRIVEN WHEEL

BACKGROUND OF THE INVENTION

The present invention relates to a device for weighing lines and/or ropes.

More specifically, the invention concerns a device of the above kind which is useful both in the mercantile navy field and in the recreation marine field.

All the device of this kind presently known have a very complicated structure, said structure negatively influencing the intervention speed when it is necessary, for example when the boat runs aground.

In fact, the known solutions do not allow recovery of the lines and/or ropes without their being damaged.

As already said, said systems do not allow the recovery of lines and ropes without the consequent damaging since the line is inserted within the cone-shaped groove and removed by a crawling body without ensuring a good grip in case the tension is reduced.

Further, said systems are not useful in the case of anchorage in deep depths since warping bells are used, upon which the lines are wound by multiple turns and manually maintained under tension until the final recovery, such a solution requiring very high physical energies.

It is well known that all the boat users are helped by devices of this kind that eliminates physical work and reduces the time necessary for recovering the lines and or ropes.

The solution proposed according to the present invention optimises existing devices, overcoming their drawbacks and therefore allowing a faster recovery and far less work for the user.

These devices are used for the recovery of anchors, anchor logs, etc.

The solution proposed according to the invention avoids slipping or breakage of the lines and/or ropes, with all the deriving advantages.

Furthermore, the device according to the invention allows a very fast recovery of many hundred meters of line and/or rope having any diameter since it can immediately conform to any diameter with the maximum safety conditions, without damaging the line.

Another object of the present invention is that of providing a device that can be employed with the existing winches, either electrically or hydraulically powered winches, having any power or of any model, or with self-powered winches.

SUMMARY OF THE INVENTION

It is therefore a specific object of the present invention to provide a device for weighing lines and/or ropes comprising a motive wheel, mounted on a hub for the connection with driving means, a driven wheel, coaxially placed with respect to said motive wheel, thrust ring means coupled with said driven wheel in such a way to be movable with respect to the motive wheel, and position adjustment means, for regulating the position of said thrust ring means and the driven wheel with respect to the motive wheel.

Preferably, according to the invention, said driving means can be comprised of the motor of a pre-existing winch, or of a specific motor for the device according to the invention.

Further, the coupling between said motive wheel and said driven wheel is preferably achieved by a step provided on said motive wheel, said step coupling in said driven wheel and having such sizes to always provide a support for the line or rope in any position of the motive wheel with respect to the driven wheel.

Still according to the invention, said thrust ring means is coupled with said driven wheel by a plurality of pins, preferably between 4 and 12, passing through corresponding seats in said motive wheel, on each one of said pins an outer spring being coaxially provided, and said seats having a substantially conical shape, said conical shape widening toward the ring means.

Furthermore, according to the invention, said adjustment means provide an element provided on said hub, said element having on one side a deflecting roll acting on said ring means and mounted idle on said element, and on the other side means for fixing the position.

In another respect the invention is a device for weighing a nautical line or the like, including a motive wheel, a driven wheel, and a thrust ring. The motive wheel and the driven wheel are adjacent to each other and they form opposite sides of a groove which receives a nautical line or the like. The motive wheel is adapted to be driven by a motor, and the motive wheel is located between the driven wheel and the thrust ring. The motive wheel is rotationally fixed to the driven wheel so that rotary motion of the motive wheel is transmitted to the driven wheel. The driven wheel is axially movable relative to the motive wheel. A plurality of axially movable pins extend through the motive wheel to rigidly connect the thrust ring to the driven wheel. A deflector engages the thrust ring to axially deflect the thrust ring toward the motive wheel and thereby deflect the driven wheel axially relative to the motive wheel. Preferably, there is a hub for supporting the motive wheel, and the deflector is mounted on a support which is mounted on the hub. The deflector is an idler roller which engages a lower portion of the thrust ring.

The present invention will be now described, for illustrative but not limitative purposes, according to one of its preferred embodiments, with particular reference to the figure of the enclosed drawing showing a section view of the device for weighing lines and/or ropes according to the invention.

DESCRIPTION OF THE PREFERRED EMBODIMENT

Observing the figure, it can be noted that the device 1 comprises a motive wheel 2 and a driven wheel 3.

Said motive wheel 2 is connected by bearings 4 to a hub 5. The motive wheel 2 has a hub 2*a* which is connected to and driven by shaft 16 of a motor shown in broken lines at 17 can be the housing of a motor of a pre-existing winch or a specific motor for the device 1 according to the invention.

An adjustment support is mounted on said hub 5, toward the motive wheel 2, said support 6 having a deflecting roll 7 mounted in such a way to be able to rotate idle with respect to the support 6 by the coupling pin 8 and the bearings 9.

The position of the adjustment support 6 on the hub 5 is adjusted by the fixing pin 10.

A thrust ring 11 is provided, said deflecting roll 7 acting by rolling on a lower portion of said ring, said ring 11 being coupled with said driven wheel 3 by a plurality of pins 12, each of which is coaxially provided with spring 13.

Said coupling pins between the driven wheel 3 and the thrust ring 11 pass through conical seats 14 formed in said motive wheel 2.

The motive wheel 2 has a step 15 in correspondence of its coupling with said driven wheel 3, having such sizes and shape to always provide a support for the line or rope to be weighed.

The position of the adjustment support determines the position and the axial opening of the driven wheel to free the line.

The particular shape of the conical seats 14 allow the thrust ring 11 to move with respect to the motive wheel 2, so that during the working of the device 1 according to the invention, it will tend, by said springs, to close the upper part of the motive wheel 2 - driven wheel 3 assembly, while opening the lower part.

In this way the above mentioned results are obtained, being it possible to rapidly recover a line, without any damaging of the same.

As it can be easily understood from the above, the device according to the present invention allows to make a high speed recovery without damaging the lines and/or ropes, with extremely safe conditions during the recovery.

Furthermore, a reduction of the accidents for the worker is obtained, the worker even working without any physical effort.

The device described is furthermore extremely cheap and easy to be mounted, and can also be provided, as already said, also on pre-existing winches having any kind of powering system.

Its structure renders it very versatile for various sizes and types of boats since the wheel can be provided in a vertical position, in a horizontal position or inclined.

Furthermore, it allows a high easy of maneuvering in case of running aground and reduction of the average costs of the fishing in view of the reduced man power requirements and higher execution speed.

The present invention has been described for illustrative, but not limitative purposes according to its preferred embodiments, but it is to be understood that modifications and/or changes can be introduced by those skilled in the art without departing from the relevant scope as defined in the enclosed claims.

We claim:

1. Device for weighing elongated members characterized in that it comprises a hub, a motive wheel mounted on the hub and adapted to be connected with a driving means, a driven wheel coaxially placed with respect to said motive wheel, a thrust ring coupled with said driven wheel in such a way to be axially movable with respect to the motive wheel, said motive wheel being located between said thrust ring and said driven wheel, and position adjustment means which is engaged with said thrust ring to regulate the axial position of said thrust ring and the driven wheel.

2. Device according to claim 1, including driving means which is the motor of a pre-existing winch.

3. Device according to claim 1, including driving means which is a specific motor for the device.

4. Device according to claim 1 characterized in that the coupling between said motive wheel and said driven wheel includes a step which is provided on said motive wheel and is coupled to said driven wheel, said wheels having sizes which together always provide a support for the line or rope in any position of the motive wheel with respect to the driven wheel.

5. Device according to claim 1, characterized in that said thrust ring means is coupled with said driven wheel by a plurality of pins passing through corresponding seats in said motive wheel, an outer spring being coaxially provided on each one of said pins, each of said seats having a substantially conical shape which widens toward the thrust ring means.

6. Device according to claim 5, characterized in that there are between 4 and 12 said pins.

7. Device according to claim 1, characterized in that said adjustment means includes an element on said hub, said element having on one side, a deflecting idler roll acting on said ring means and on the other side means for fixing the position of said element on the hub.

8. A device for weighing a nautical line comprising a motive wheel, a driven wheel, and a thrust ring, said motive wheel and said driven wheel being adjacent to each other and forming opposite sides of a groove for receiving a nautical line or the like, said motive wheel being adapted to be driven by a motor;

said motive wheel being located between said driven wheel and said thrust ring, said motive wheel being rotationally fixed to said driven wheel so that rotary motion of the motive wheel is transmitted to the driven wheel, said driven wheel being axially movable relative to the motive wheel, a plurality of axially movable pins which extend through said motive wheel to rigidly connect the thrust ring to the driven wheel, and a deflector which engages the thrust ring to axially deflect the thrust ring toward said motive wheel and thus deflect the driven wheel axially relative to the motive wheel.

9. A device according to claim 8 having a hub for supporting said motive wheel, a support which is mounted on the hub, said deflector being mounted on the support.

10. A device according to claim 8 wherein said deflector is an idler roller which engages a lower portion of the thrust ring.

* * * * *